US012227278B1

(12) United States Patent
Jaszewski et al.

(10) Patent No.: US 12,227,278 B1
(45) Date of Patent: Feb. 18, 2025

(54) TRANSOM BRACKET ASSEMBLY HAVING VIBRATION ISOLATION

(71) Applicant: Brunswick Corporation, Mettawa, IL (US)

(72) Inventors: Wayne M. Jaszewski, West Bend, WI (US); Andrew J. Przybyl, Berlin, WI (US); Colin M. Huffer, Neenah, WI (US); Thomas F. Nickols, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 18/079,374

(22) Filed: Dec. 12, 2022

(51) Int. Cl.
*B63H 20/12* (2006.01)
*B63H 20/06* (2006.01)
*B63H 21/30* (2006.01)

(52) U.S. Cl.
CPC ..... *B63H 20/06* (2013.01); *B63H 20/12* (2013.01); *B63H 21/305* (2013.01)

(58) Field of Classification Search
CPC ..... B63H 20/06; B63H 20/12; B63H 21/305
See application file for complete search history.

(56) References Cited

U.S. PATENT DOCUMENTS 8,820,701 B1 * 9/2014 Eichinger ..... B63H 20/12 248/610
9,205,906 B1 12/2015 Eichinger
9,701,383 B1 * 7/2017 Stuber ..... B63H 20/10
9,963,213 B1 * 5/2018 Jaszewski ..... B63H 20/10
11,097,824 B1 * 8/2021 Anderson, Jr. ..... B63H 20/12
11,866,137 B1 * 1/2024 Jaszewski ..... B63H 20/06
2009/0170384 A1 * 7/2009 Balogh ..... B63H 20/08 440/53
2013/0316603 A1 * 11/2013 Hagi ..... B63H 20/02 440/53
2019/0344873 A1 11/2019 Kimpara
2021/0394882 A1 * 12/2021 Waldvogel ..... B63B 43/18
2023/0257095 A1 * 8/2023 Waldvogel ..... H02K 5/207 440/76

OTHER PUBLICATIONS

Unpublished U.S. Appl. No. 17/487,116, "Outboard Motor that ss Removable from Transom Clamp Bracket".
Unpublished U.S. Appl. No. 17/509,739, "Integrated Copilot and Locking Mechanism for Marine Drives".
(Continued)

*Primary Examiner* — Amy J. Sterling
(74) *Attorney, Agent, or Firm* — Andrus Intellectual Property Law, LLP

(57) ABSTRACT

An outboard marine propulsion assembly includes a marine drive having a supporting frame and a steering arm extending from the supporting frame, a transom bracket assembly, a swivel member seated in the transom bracket assembly, the swivel member being configured so that rotation of the steering arm relative to the transom bracket assembly rotates the swivel member relative to the transom bracket assembly to thereby steer the marine drive, an upper vibration isolating joint which couples the steering arm to the supporting frame, and a lower vibration isolating joint which couples the swivel member to the supporting frame.

18 Claims, 8 Drawing Sheets

(56) References Cited

OTHER PUBLICATIONS

Unpublished U.S. Appl. No. 17/852,944, "Copilot Devices and Apparatuses for Supporting Marine Drives Having a Copilot Device".
Unpublished U.S. Appl. No. 17/884,355, "Transom Bracket Assemblies for Supporting a Marine Drive on a Vessel".
Office Action issued in U.S. Appl. No. 17/487,116, dated Nov. 8, 2024.

* cited by examiner

TRANSOM BRACKET ASSEMBLY HAVING VIBRATION ISOLATION

FIELD

The present disclosure relates to marine drives, and more particularly to outboard marine propulsion assemblies having vibration isolators.

BACKGROUND

The following U.S. Patents are incorporated herein by reference in entirety:

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/509,739 discloses an apparatus for removably supporting a marine drive on a marine vessel. The apparatus has a transom bracket assembly for mounting to the marine vessel, a steering bracket for coupling the marine drive to the transom bracket assembly so the marine drive is steerable relative to the transom bracket assembly and the marine vessel; and an integrated copilot and locking mechanism configured to retain the steering bracket in a plurality of steering orientations. The mechanism is further configured to lock and alternately unlock the steering bracket relative to the transom bracket assembly so that in a locked position the marine drive is retained on the transom bracket assembly and so that in an unlocked position the marine drive is removable from the transom bracket assembly.

U.S. patent application Ser. No. 17/852,944 discloses an apparatus for supporting a marine drive on a marine vessel. The apparatus has a transom bracket comprising a swivel cylinder and a steering bracket configured to couple the marine drive to the transom bracket, the steering bracket comprising a steering arm and a swivel tube seated in the swivel cylinder, wherein steering of the steering arm relative to the transom bracket rotates the swivel tube in the swivel cylinder and thereby steers the marine drive. A copilot device is configured to frictionally restrain rotation of the swivel tube in the swivel cylinder by applying diametrically opposing pushing and pulling forces on the swivel tube.

U.S. patent application Ser. No. 17/884,355 discloses a transom bracket assembly for supporting a marine drive on a marine vessel. The assembly comprises a transom bracket comprising a swivel cylinder, a steering arm extending from the marine drive, a swivel tube having a first end coupled to the steering arm and a second end seated in the swivel cylinder so that steering of the steering arm relative to the transom bracket rotates the swivel tube in the swivel cylinder about a steering axis for the marine drive, and a yoke which couples the second end of the swivel tube to the marine drive.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

An outboard marine propulsion assembly includes a marine drive having a supporting frame and a steering arm extending from the supporting frame, a transom bracket assembly, a swivel member seated in the transom bracket assembly, the swivel member being configured so that rotation of the steering arm relative to the transom bracket assembly rotates the swivel member relative to the transom bracket assembly to thereby steer the marine drive, an upper vibration isolating joint which couples the steering arm to the supporting frame, and a lower vibration isolating joint which couples the swivel member to the supporting frame.

In some embodiments, all vibrations of the marine drive may be transmitted to the transom bracket assembly via the upper vibration isolating joint and the lower vibration isolating joint. The upper vibration isolating joint and the lower vibration isolating joint may be configured to isolate all vibrations emanating from the marine drive to the transom bracket assembly. The swivel member may define a steering axis for the marine drive. The upper vibration isolating joint and the lower vibration isolating joint each may be elongated in a lateral direction which is perpendicular to the steering axis, and/or the upper vibration isolating joint and the lower vibration isolating joint may be parallel to each other. The upper vibration isolating joint and the lower vibration isolating joint may be spaced apart from each other relative to the steering axis. The upper vibration isolating joint and the lower vibration isolating joint each may include a rigid connector and a resilient sleeve on the rigid connector, the resilient sleeve being configured to isolate the vibrations emanating from the marine drive to the transom bracket assembly. The resilient sleeve may include a plurality of radial ridges. The upper vibration isolating joint and the lower vibration isolating joint may each rotate about the steering axis when the marine drive is steered.

The outboard marine propulsion assembly may include an upper yoke which couples the steering arm to the supporting frame and a lower yoke which couples the swivel member to the supporting frame. The upper vibration isolating joint may extend through the upper yoke, and the lower vibration isolating joint may extend through the lower yoke. The upper vibration isolating joint may extend through an upper portion of the supporting frame and the lower vibration isolating joint may extend through a lower portion of the supporting frame. Additionally or alternatively, the rigid connector may include opposing eyelets for receiving fasteners for fixing the rigid connector.

An outboard marine propulsion assembly includes, a marine drive having a supporting frame, a transom bracket assembly, a swivel member coupled to the supporting frame and being seated in the transom bracket assembly, wherein the swivel member and the supporting frame are steerable relative to the transom bracket assembly to thereby steer the marine drive, and a vibration isolating assembly which couples the swivel member to the supporting frame and is configured to isolate vibrations emanating from the marine drive to the transom bracket assembly.

In some embodiments, the vibration isolating assembly may include an upper vibration isolating joint which couples an upper portion of the swivel member to the supporting frame, and a lower vibration isolating joint which couples the lower portion of the swivel member to the supporting frame. The outboard marine propulsion assembly may include an upper yoke which couples the upper portion of the swivel member to the supporting frame and a lower yoke which couples the lower portion of the swivel member to the supporting frame. The swivel member may define a steering axis for the marine drive and wherein the upper vibration isolating joint and the lower vibration isolating joint each may be elongated in a lateral direction which is perpendicular to the steering axis. The supporting frame may extend from a top to a bottom in a longitudinal direction, from a port side to a starboard side in a lateral direction which is perpendicular to the longitudinal direction, and from a front to a rear in an axial direction which is perpendicular to the longitudinal direction and perpendicular to the lateral direction, and wherein the upper vibration isolating joint and the lower vibration isolating joint are parallel to each other and elongated in the lateral direction. The upper vibration isolating joint and the lower vibration isolating joint each may comprise a rigid connector and a resilient sleeve on the rigid connector, the resilient sleeve being configured to isolate the vibrations emanating from the marine drive to the transom bracket assembly.

BRIEF DESCRIPTION OF THE DRAWINGS

The present disclosure includes the following Figures.

DETAILED DESCRIPTION

Figure 1:
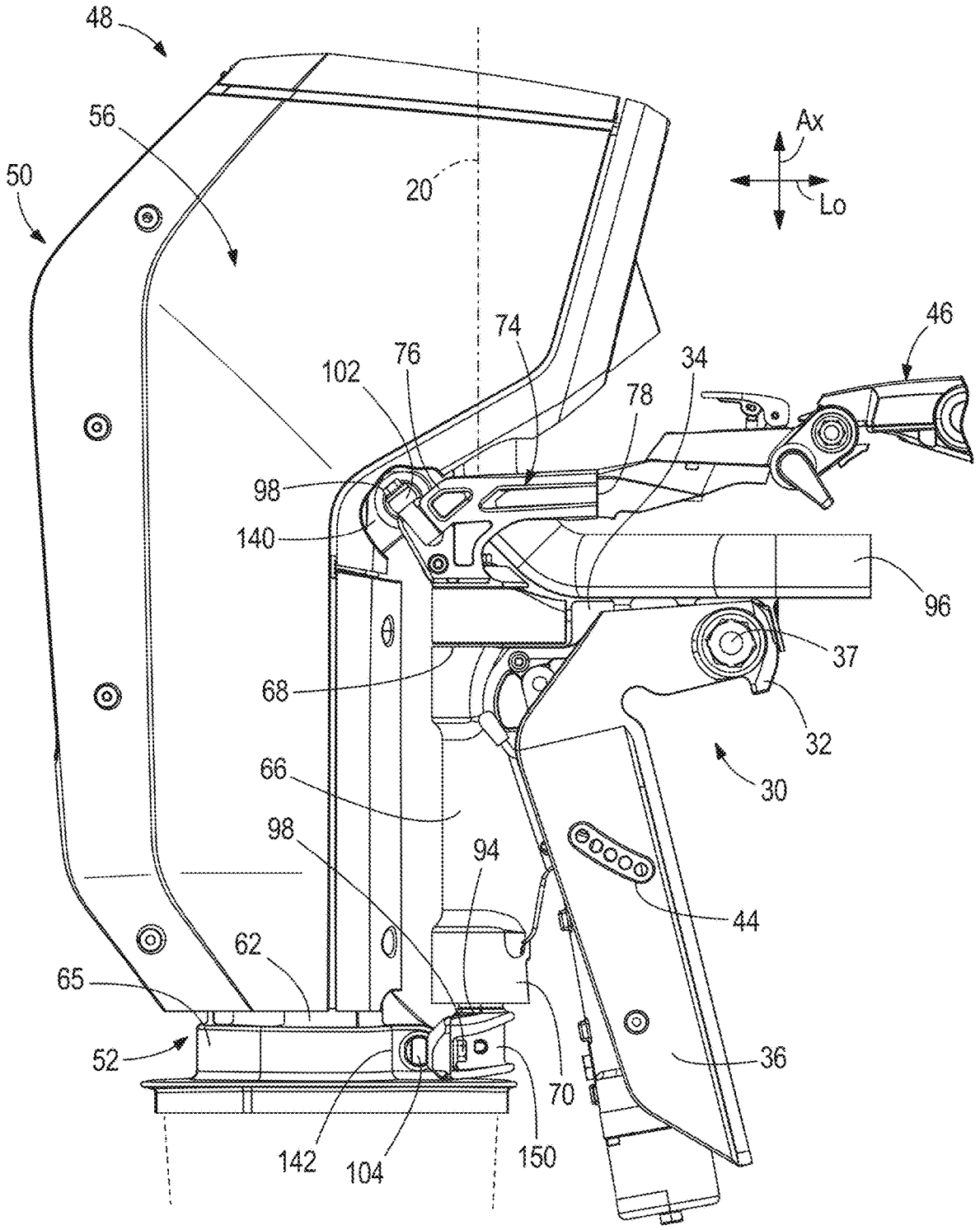
FIG. 1 is a side view of a marine propulsion assembly including a marine drive and a transom bracket assembly configured to support the marine drive on the transom of a marine vessel.

FIG. 1 depicts an outboard marine propulsion assembly 48 including a marine drive 50 for propelling a marine vessel in a body of water. In the illustrated embodiment, the marine drive 50 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. A transom bracket assembly 30 supports the marine drive 50 on the transom (not shown) of the marine vessel such that the marine drive 50 is trimmable up and down relative to the transom bracket assembly 30, including in non-limiting examples wherein the marine drive 50 is raised completely out of the water.

The marine drive 50 includes a supporting frame 52 for rigidly supporting the various components of the marine drive 50 with respect to the marine vessel and a lower unit (not shown) supported by the supporting frame 52. The lower unit includes a propulsor housing (not shown), which defines a watertight lower housing cavity for containing a motor (not shown) and related componentry. A conventional propulsor (not shown) is mounted on the outer end of a propulsor shaft extending from the propulsor housing such that rotation of the propulsor shaft by the motor causes rotation of the propulsor, which in turn generates a thrust force for propelling the marine vessel in water. It should be understood that the various components described above are exemplary and could vary from what is shown.

The supporting frame 52 has body (not shown) and a support leg 62 extending downwardly from the bottom of the body to the lower unit. The supporting frame 52 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. In the illustrated embodiments, the support leg 62 is configured to be secured to the body with at least one fastener. Other embodiments, however, may include a supporting frame 52 with a body that is integrally formed with the support leg 62. A cowling 56 is fixed to and surrounds most or all of the supporting frame 52. The cowling 56 defines a cowling interior in which at least a portion of the supporting frame 52 is enclosed and various components of the marine drive 50 are disposed. It should be understood that the various components described above are exemplary and could vary from what is shown.

With continued reference to FIG. 1, the marine drive 50 is supported relative to the transom of a marine vessel by a transom bracket assembly 30, which in the illustrated example includes a transom bracket 32 configured to be fixed to the transom and a swivel bracket 34 pivotably coupled to the transom bracket 32. The transom bracket 32 has a pair of C-shaped arms 36 which fit over the top of the transom and a pair of threaded, plunger-style clamps 38 which clamp the C-shaped arms 36 to the transom configured to be clamped to the transom between the C-shaped arms 36 by plunger-style clamps (not shown). In some embodiments, the transom bracket 32 is additionally or alternatively fixed to the transom by at least one fastener (not shown).

The swivel bracket 34 is pivotable with respect to the C-shaped arms 36 about a pivot shaft 37 that laterally extends through the forward upper ends of the C-shaped arms 36, thereby defining a trim axis that is generally parallel to the lateral axis LA. Pivoting of the swivel bracket 34 about the pivot shaft 37 trims the marine drive 50 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the marine drive 50. A selector pin (not shown) can be manually inserted into the aligned holes to thereby lock the marine drive 50 in place with respect to the pivot shaft 37.

Figure 2:
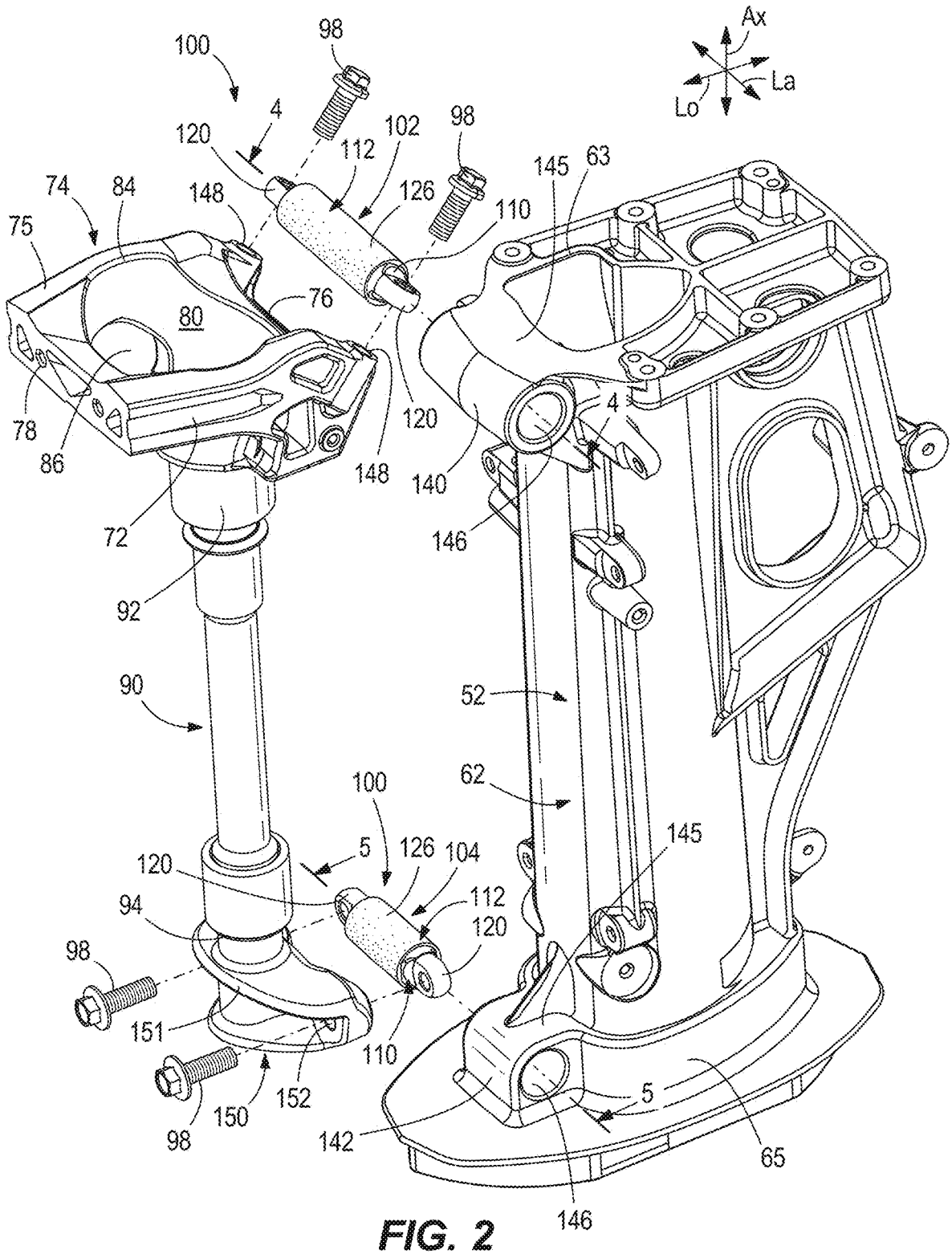
FIG. 2 is an exploded perspective view of the supporting frame, steering arm, swivel member and vibration isolating assembly from the marine propulsion assembly of FIG. 1.

Referring to FIGS. 1 and 2, the marine drive 50 is supported on the swivel bracket 34 by a steering arm 74, which extends from the body of the supporting frame 52 of the marine drive 50, generally along the midsection of the marine drive 50. A first end 76 of the steering arm 74 is coupled to the supporting frame 52 and an opposite, second end 78 of the steering arm 74 is coupled to a manually operable tiller 46. A swivel member 90 extends transversely from the steering arm 74 and is configured to be nested in the transom bracket assembly 30. In the illustrated embodiments, for example, the swivel member 90 is rotatably received in a swivel cylinder 66 of the swivel bracket 34. The marine drive 50 can be steered left or right relative to the marine vessel by rotating about the steering axis 20, which is defined by the swivel member 90 and swivel cylinder 66, via the manually operable tiller 46 (partially shown in FIG. 1) and/or any other known apparatus for steering a marine drive with respect to a marine vessel.

As best illustrated in FIG. 2, the steering arm 74 includes a body 72 with a through-bore 80 through which a flexible rigging connector and a guide member 96 (see FIG. 1) extend. The guide member 96 is configured to guide the flexible rigging connector through the steering arm 74 and over the transom bracket assembly 30. The through-bore 80 is formed through the body 72 of the steering arm 74 from top to bottom and defines a passageway through the steering arm from an upper opening 84 to a lower opening 86. The upper opening 84 is formed in an upper surface 75 of the steering arm between the first and second ends 76, 78 thereof. The lower opening 86 of the through-bore 80 is located between the swivel member 90 and the second end 78 of the steering arm 74 so that the flexible rigging connector and guide member 96 exit the through-bore 80 below the second end 78. It should be noted that the shape and configuration of these components can vary widely from what is illustrated as long as the above-described functionality is provided. For example, the shape(s) and/or direction (s) of the through-bore can vary from what is shown and described to accommodate different embodiments. These can all be optimized based upon the particular embodiments.

The swivel member 90 is generally cylindrical and extends downward from an upper portion 92 connected to the body of the steering arm 74 to a lower portion 94 that protrudes from a bottom portion 70 of the swivel cylinder (see FIG. 1). The upper portion 92 may be coupled to the steering arm 74 by a fastener. Some embodiments, however, may be configured with a steering member that is integrally formed with the steering arm 74. The swivel member 90 is received via an upper portion 68 of the swivel cylinder 66 and is permitted to rotate therein. Thus, the swivel member 90 is configured so that so that the swivel member 90, the steering arm 74, and the marine drive 50 pivot together about the steering axis 20. Rotation of the steering arm 74 relative to the transom bracket assembly 30 rotates the swivel member 90 relative to the transom bracket assembly 30 to thereby steer the marine drive 50.

Figure 3:
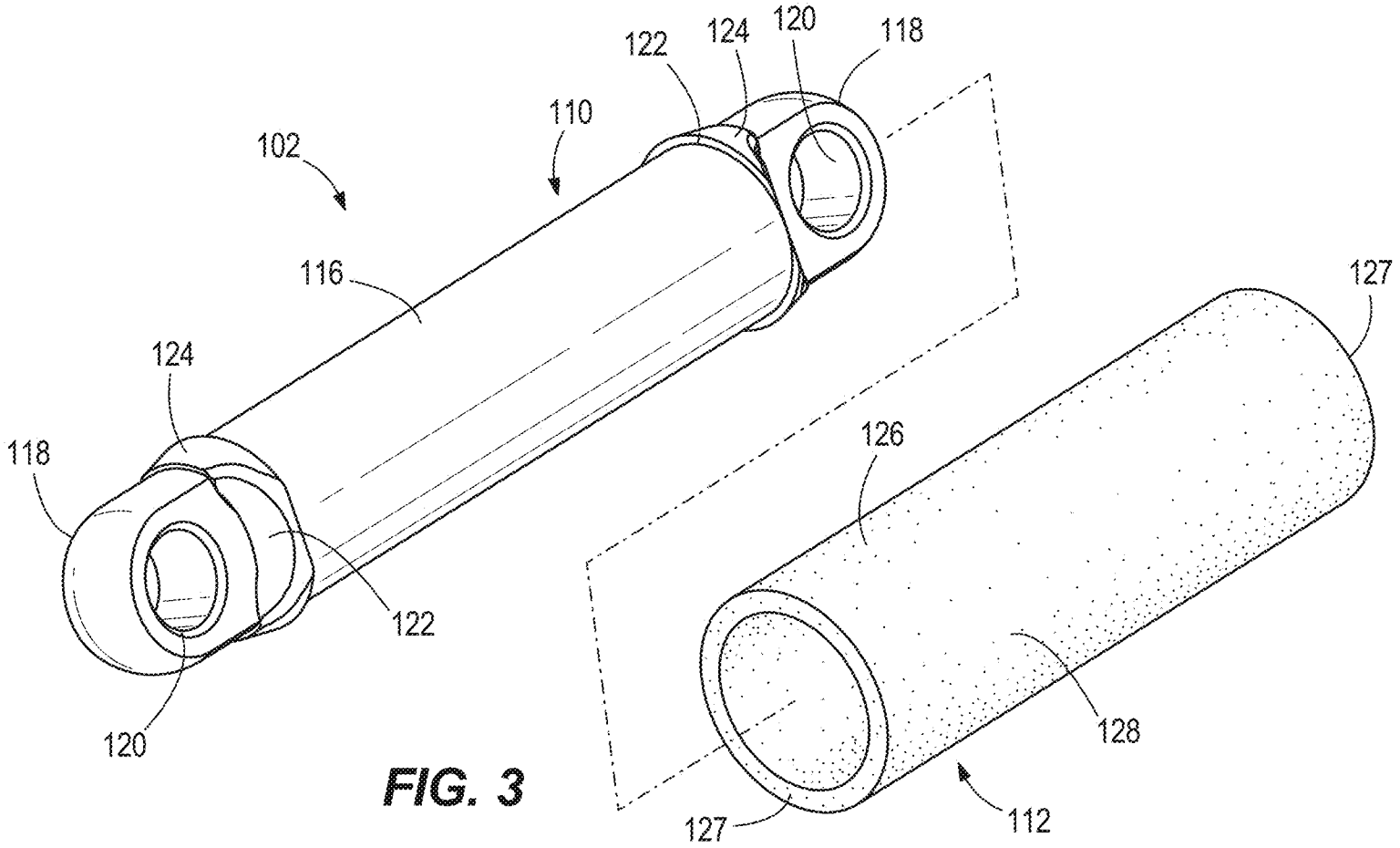
FIG. 3 is an exploded perspective view of a vibration isolating joint of the vibration isolating assembly of FIG. 2.

Embodiments of the outboard marine propulsion assembly 48 may include a novel vibration isolating assembly 100 which couples the swivel member 90 to the supporting frame 52 and is configured to isolate vibrations emanating from the marine drive 50 to the transom bracket 32. Referring to FIGS. 2 and 3, for example, the vibration isolating assembly 100 includes an upper vibration isolating joint 102 and a lower vibration isolating joint 104 that are spaced apart from each other relative to the steering axis 20. Each of the vibration isolating joints 102, 104 extends through a portion of the supporting frame 52 to support the marine drive 50 on the transom bracket assembly 30. The upper vibration isolating joint 102 and the lower vibration isolating joint 104 are each coupled to the swivel member 90 such that these components rotate about the steering axis 20 when the marine drive 50 is steered.

The upper and lower vibration isolating joints 102, 104 are generally parallel to each other and are elongated in a lateral direction LA, which is perpendicular to the steering axis 20. Referring to FIG. 3, the upper vibration isolating joint 102 and the lower vibration isolating joint 104 each include a rigid connector 110 and a resilient sleeve 112 received on the rigid connector 110. The rigid connector 110 has a cylindrical body 116 that extends laterally between opposite lateral ends 118. At the lateral ends 118, the rigid connectors 110 each include opposing eyelets 120 that are configured to receive a fastener 98 for fixing the rigid connector 110 to the upper or lower portion of swivel member 90. Flanges 122 are positioned at each lateral end 118 between the cylindrical body 116 and the eyelets 120. The flanges 122 extend around at least a portion of the cylindrical body 116 and are configured to retain the resilient sleeve 112 on the rigid connector 110. Each flange 122 has a laterally outer surface 124 that tapers from the adjacent eyelet 120 to a radially outermost point on the flange 122. This may be useful, for example, to provide a ramped surface that the resilient sleeve 112 can slide over when positioning the resilient sleeve 112 on the rigid connector 110. It is not essential to include the flanges 122. For example the resilient sleeve 112 could also or alternately be bonded to the rigid connector 110.

Figure 4:
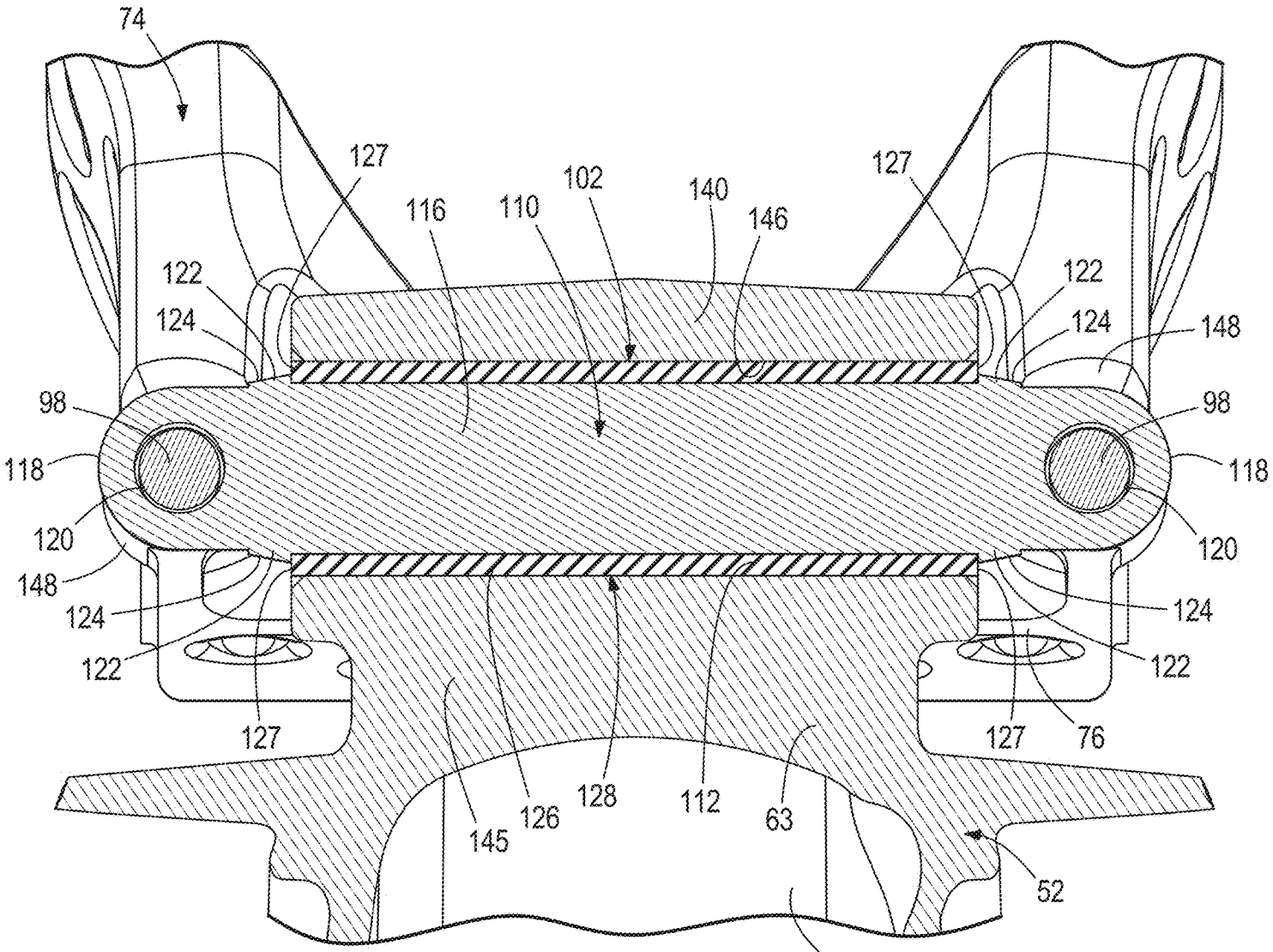
FIG. 4 is a view of section 4-4, taken in FIG. 2.
Figure 5:
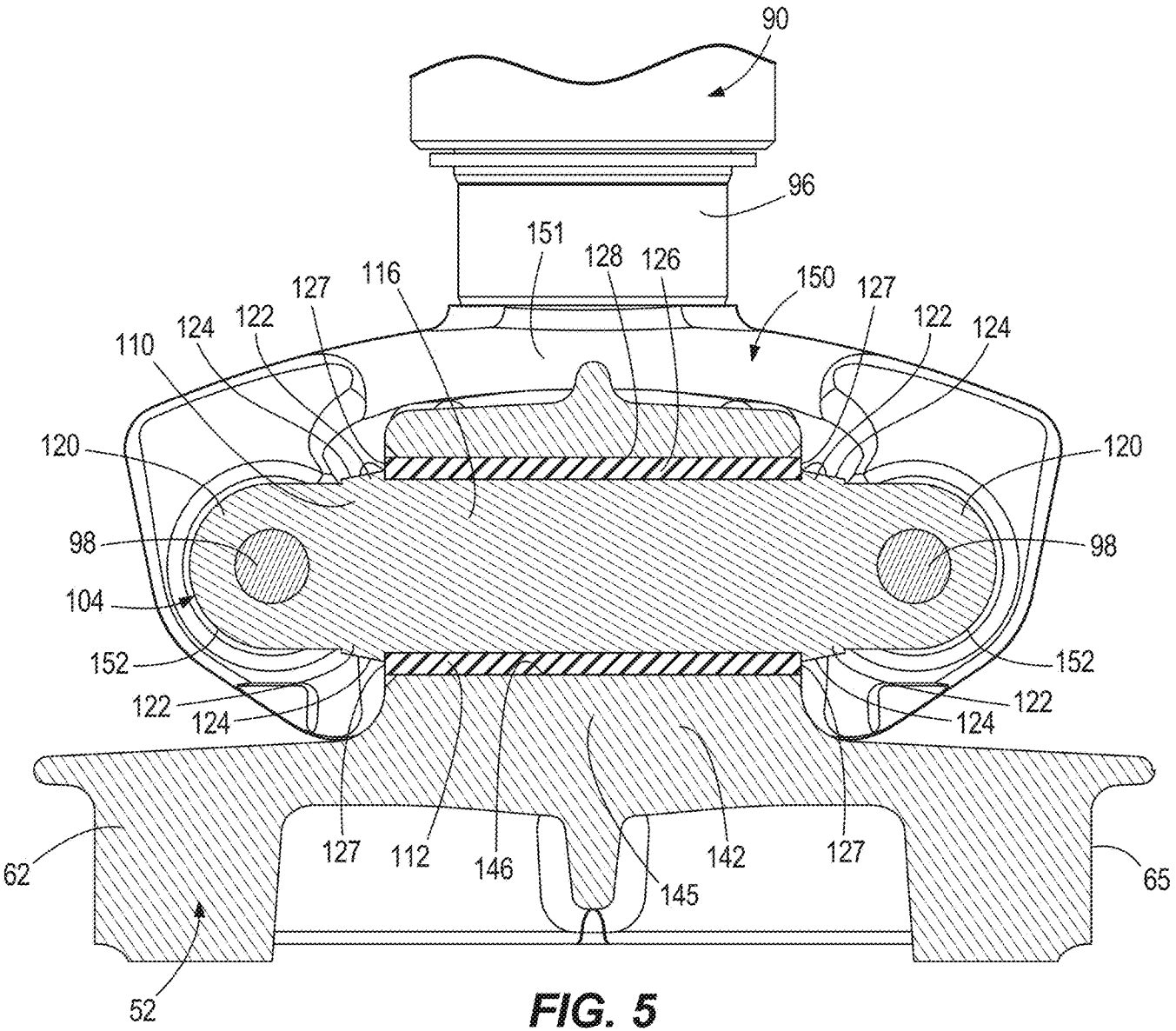
FIG. 5 is a view of section 5-5, taken in FIG. 2.
Figure 6:
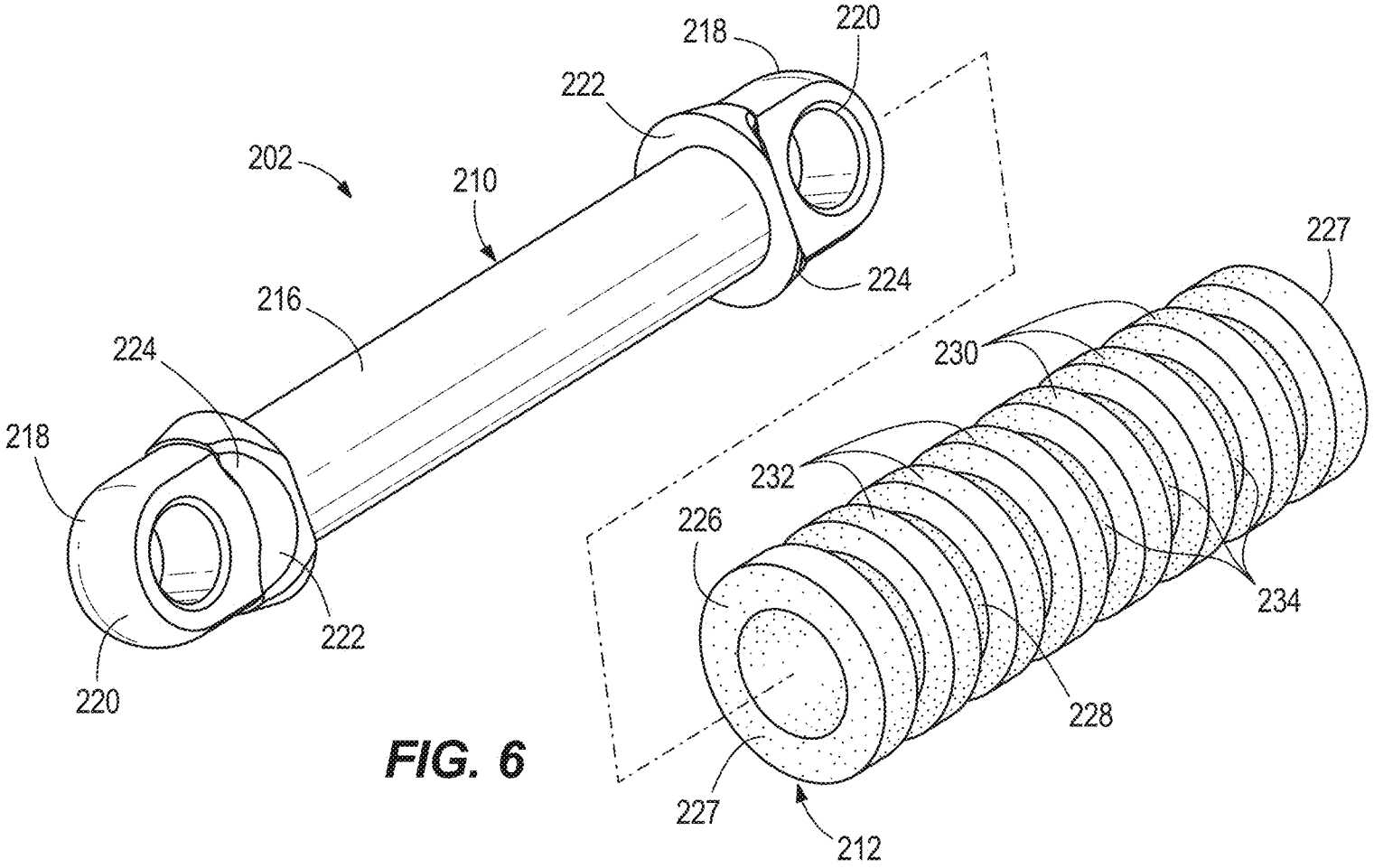
FIG. 6 is an exploded perspective view of another embodiment of a vibration isolating joint.

The resilient sleeves 112 are configured to isolate vibrations emanating from the supporting frame 52 and have a generally tubular body 126 that extends laterally between opposing sides 127 thereof. In some embodiments, the body 126 of the resilient sleeve 112 may be formed from an elastomeric material (e.g., natural or synthetic rubber and/or another rubber-like material). The resilient sleeves 112 also provide strain relief to the supporting frame 52 and transom bracket assembly 30 when subjected to operating loads, including but not limited to wave-induced loads, logstrikes, and/or the like. Other embodiments of the resilient sleeve 112 may be formed from a different dampening material (e.g., a foam-like material). Each resilient sleeve 112 is positioned on the cylindrical body 116 of one of the rigid connectors 110 between the flanges 122. The flanges 122 abut the lateral sides 127 of the resilient sleeves 112 to restrict lateral movement of the resilient sleeves 112 on the cylindrical body 116. In the embodiments of FIGS. 3-5, the bodies 116 of the resilient sleeves 112 have a generally smooth outer surface 128. However, as discussed in reference to FIGS. 6-8 below, some embodiments may have a differently configured outer surface 128.

With continued reference to FIGS. 2 and 3, the upper vibration isolating joint 102 couples the upper portion 92 of the swivel member 90 to the supporting frame 52 and the lower vibration isolating joint 104 couples the lower portion 94 of the swivel member 90 to the supporting frame 52. The supporting frame 52 includes an upper yoke 140 positioned proximate an upper end of the supporting frame 52 and a lower yoke 142 positioned at a lower end of the supporting frame 52. In particular, the illustrated upper yoke 140 is formed proximate the top end 63 the support leg 62 below the body of the supporting frame 52 and the illustrated lower yoke 142 is positioned proximate a bottom end 65 of the support leg 62. The upper and lower yokes 140, 142 each have a body 145 that is integrally formed with the support leg 62. A through-bore 146 extends laterally between opposing port and starboard sides of the yoke 140, 142 and is configured to receive the upper or lower vibration isolating joint 102, 104.

The upper yoke 140 is configured to receive the upper vibration isolating joint 102 to couple the steering arm 74 and the upper portion 92 of the swivel member 90 to the supporting frame 52. The upper vibration isolating joint 102 extends through the upper through-bore 146 so that the opposing eyelets 120 of the upper vibration isolating joint 102 protrude from the opposing lateral sides of the upper yoke 140. The eyelets 120 of the upper vibration isolating joint 102 each correspond to a mounting opening 148 formed in the first end 76 of the steering arm 74. Fasteners 98 can be inserted through the eyelet 120 to engage the mounting openings 148 to couple the steering arm 74 to the upper vibration isolating joint 102 and the supporting frame 52. In other examples, longer fasteners 98 may extend through through-holes in the eyelets 120 and nuts (not shown) can be provided on the back side for securing the fasteners 98.

The lower yoke 142 is configured to receive the lower vibration isolating joint 104 to couple the lower portion 94 of the swivel member 90 to the supporting frame 52. The lower vibration isolating joint 104 extends through the lower through-bore 146 so that the opposing eyelets 120 of the lower vibration isolating joint 104 protrude from the opposing lateral sides of the lower yoke 142. A lower swivel bracket 150 is rigidly secured to the lower portion 94 of the swivel member 90 such that the lower swivel bracket 150 rotates with the swivel member 90 and the marine drive 50 about the steering axis 20. The lower mounting bracket 150 has a body 151. Mounting openings 152 are formed longitudinally through the lower swivel bracket 150 and are spaced laterally apart from each other so that one mounting opening 152 is positioned on the port and starboard sides of the swivel member 90. Each lower mounting opening 152 aligns with a corresponding one of the lower eyelet 120 that extends from opposite lateral sides of the lower yoke 142. Fasteners 98 can be inserted through the lower eyelets 120 to engage the mounting openings 152, thereby coupling the lower portion of the swivel member 90 to the lower vibration isolating joint 104 and the bottom end of the supporting frame 52.

In the illustrated embodiments, the fasteners 98 extend through the openings in the eyelets 120 to threadedly engage the upper or lower mounting openings 148, 152 to couple the vibration isolating joints 102, 104 and the supporting frame 52 to the swivel member 90. Some embodiments, however, may be configured having at least one fastener 98 that extends through the one of the eyelets 120 and a corresponding mounting opening 148, 152 to engage a nut (not shown) to couple the vibration isolating joints 102, 104 and the supporting frame 52 to the swivel member 90. Further still, some embodiments may include at least one fastener 98 that threadedly engages an eyelet 120 of a rigid connector 110 as well as the corresponding mounting opening 148, 152 in the upper yoke 140 or the lower yoke 142.

The dimensions of at least one of the upper or lower vibration isolating joints 102, 104 may be different than those of the illustrated embodiments. In the illustrated embodiments, the upper vibration isolating joint 102 is longer in a lateral dimension LA (which corresponds to the distance between the mounting openings 148 in the steering arm 74) than the lower vibration isolating joint 104 (the lateral dimension of which corresponds to the to the distance between the mounting openings 152 in the lower swivel bracket 150). Other embodiments, however, may be configured with a lower vibration isolating joint 104 which is longer in the lateral dimension LA than the upper vibration isolating joint 102, or with an upper vibration isolating joint 102 that is the same size as the lower vibration isolating joint 104.

The vibration isolating assembly 100 is configured to support the marine drive 50 such that all vibrations of the marine drive 50 are isolated from the transom bracket assembly 30 by the upper vibration isolating joint 102 and the lower vibration isolating joint 104. Referring to FIGS. 4 and 5, upper and lower joints 102, 104 support the marine drive 50 on the transom bracket assembly 30 via the resilient sleeves 112 of the vibration isolating joints 102, 104. All vibrations emanating from the marine drive 50 are transferred to the elastomeric body 126 of the resilient sleeves 112 of the vibration isolating joints 102, 104 before being transferred to the transom bracket assembly 30. This may be useful, for example, in order to reducing problematic noise created by the vibrations, and/or to reduce the force between the marine drive 50 and the transom bracket assembly 30 in the event that the marine vessel, the marine drive 50 or the transom bracket assembly 30 are struck by an object.

Figure 7:
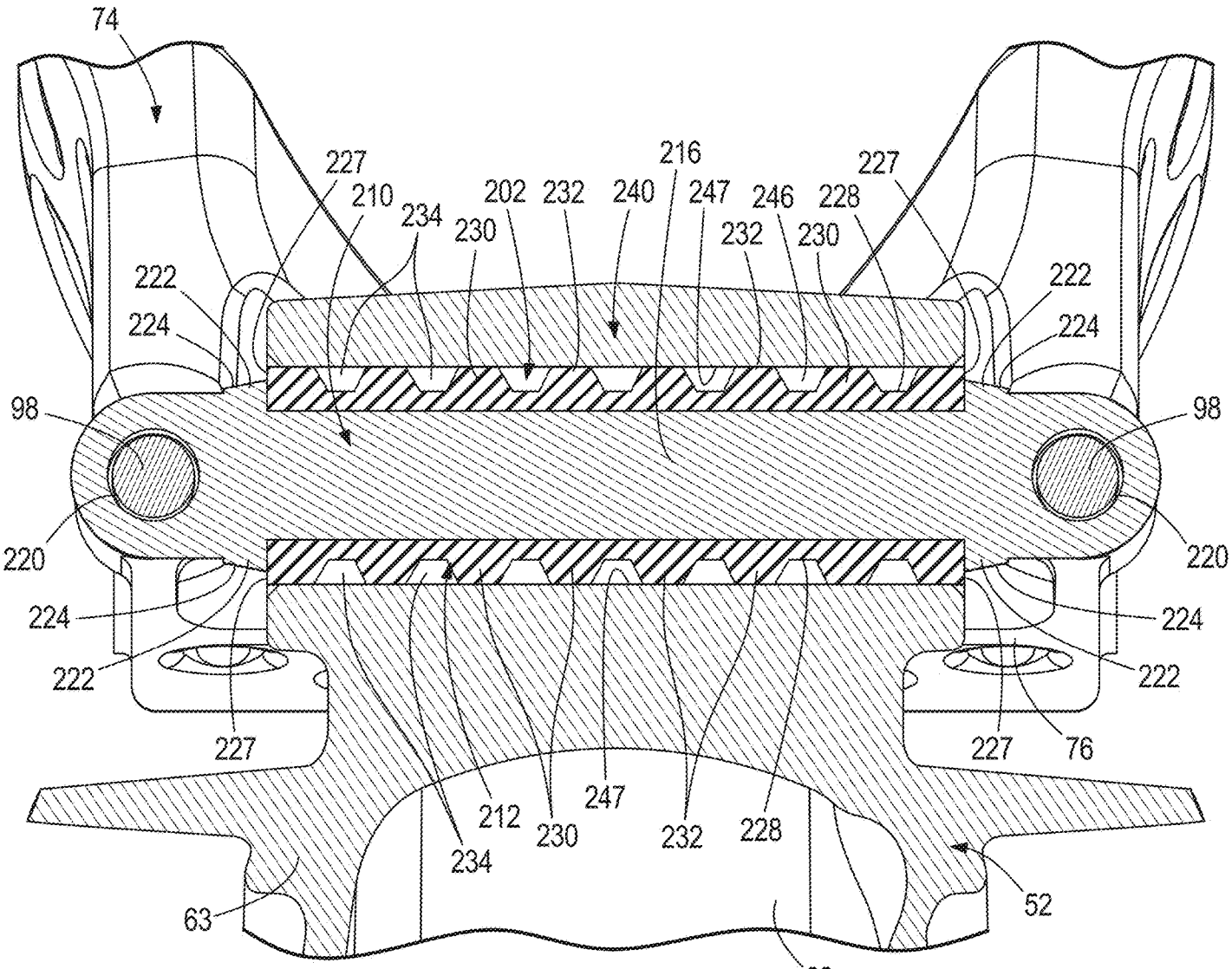
FIG. 7 is a view of section 4-4, taken in FIG. 2, with the vibration isolating joint of FIG. 6.
Figure 8:
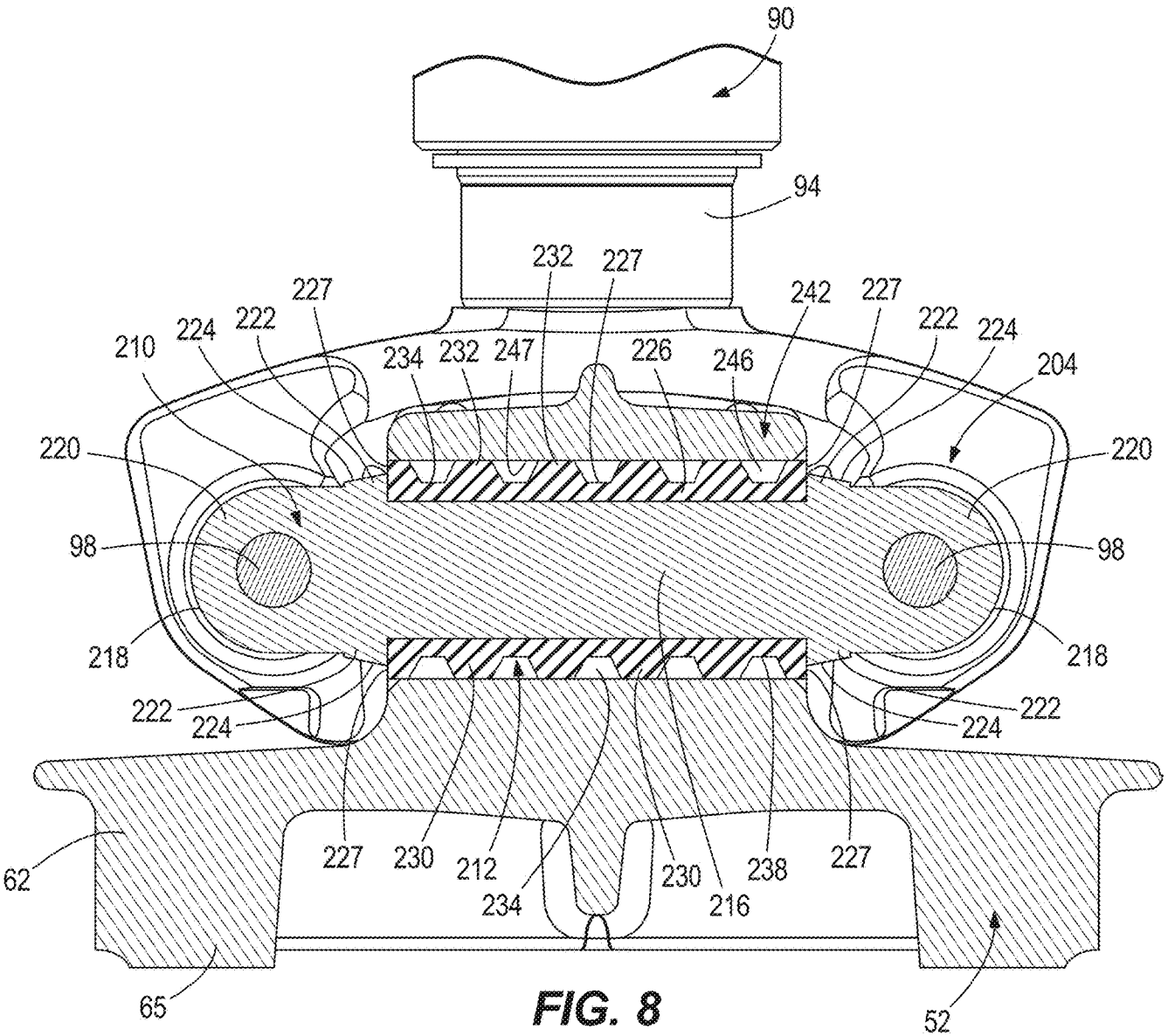
FIG. 8 is a view of section 5-5, taken in FIG. 2, with the vibration isolating joint of FIG. 6.

Some embodiments of a vibration isolating system may include at least one vibration isolating joint with a differently configured resilient sleeve. For example, referring to FIGS. 6-8, a vibration isolating system may include an upper vibration isolating joint 202 and/or a lower vibration isolating joint 204 with a plurality of radial ridges 230 formed around the outer surfaces of the resilient sleeves 212. Like the embodiments of FIGS. 2-5, the upper and lower vibration isolating joints 202, 204 of FIGS. 6-8 each include a rigid connector 210 and a resilient sleeve 212 positioned on the body 216 of the rigid connector 210. The resilient sleeves 212 are configured to be retained on the rigid connectors 210 by flanges 222 positioned between the cylindrical body 216 and the eyelets 220 at opposing lateral ends 218 of the rigid connector 210. The resilient sleeve 212 has a tubular body 226 with radially extending ridges 230 that are spaced axially along the length of the resilient sleeve 212 between opposing later sides 227 thereof. Similarly to the embodiments of FIGS. 1-5, the laterally outer surface 224 of each flange 222 may be tapered for inserting the resilient sleeve 212 onto the rigid connector 210. The ridges 230 each have a peak 232, and grooves 234 are defined between adjacent ridges 230. As illustrated in FIGS. 7 and 8, the vibration isolating joints 202, 204 are configured to be received in the through-bores 246 of upper and lower yokes 240, 242 such that the peaks 232 of the radial ridges 230 abut the inner surface 247 of the through-bores 246. The peak 232 of each ridge 230 is generally flat and forms a circumferential ring around the body 226 of the resilient sleeve 212 and are configured to abut the inner surface 247 of the through-bore 246 in the corresponding upper or lower yoke 240, 242. The outer surface 228 of the body 226 of each resilient sleeve 212 is spaced apart from and does not make contact with the inner surface 247 of the corresponding through-bores 246. This may be useful, for example, in order to reduce the area of the contact surface between the upper and lower vibration isolating joints 202, 204 and the yokes 240, 242 of supporting frame to limit the transfer of vibrations to the transom bracket assembly 30 from the marine drive 50. In some embodiments, the grooves 234 may be filled with another vibration dampening material, such as a vibration dampening foam.

Some embodiments may be configured differently than what is described herein above. For example, in other examples the marine drive 50 may omit the vibration isolating system and instead have fixed mountings or monolithic components, or other means providing a fixed coupling between the steering arm and supporting frame.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An outboard marine propulsion assembly comprising:

a marine drive having a supporting frame that extends from a top to a bottom in a longitudinal direction, from a port side to a starboard side in a lateral direction which is perpendicular to the longitudinal direction, and from a front to a rear in an axial direction which is perpendicular to the longitudinal direction and perpendicular to the lateral direction, a transom bracket assembly for coupling the marine drive to a marine vessel, a steering arm and a swivel member that extends from the steering arm and is seated in the transom bracket assembly, the steering arm and the swivel member being rotatable together relative to the transom bracket assembly to steer the marine drive relative to the marine vessel, an upper vibration isolating joint that couples the steering arm to the supporting frame, and a lower vibration isolating joint that couples the swivel member to the supporting frame, wherein at least one of the upper vibration isolating joint and the lower vibration isolating joint comprises a rigid connector that is elongated in the lateral direction and a resilient sleeve on the rigid connector that is elongated in the lateral direction and configured to isolate vibrations that emanate from the supporting frame.

2. The outboard marine propulsion assembly according to claim 1, wherein the upper vibration isolating joint and the lower vibration isolating joint are configured to isolate all vibrations emanating from the marine drive to the transom bracket assembly.

3. The outboard marine propulsion assembly according to claim 1, wherein the swivel member defines a steering axis for the marine drive, and wherein the upper vibration isolating joint and the lower vibration isolating joint are both transversely elongated relative to the steering axis.

4. The outboard marine propulsion assembly according to claim 3, wherein the upper vibration isolating joint and the lower vibration isolating joint are parallel to each other.

5. The outboard marine propulsion assembly according to claim 3, wherein the upper vibration isolating joint and the lower vibration isolating joint are spaced apart from each other relative to the steering axis.

6. The outboard marine propulsion assembly according to claim 3, wherein both of the upper vibration isolating joint and the lower vibration isolating joint comprises a respective rigid connector that is elongated in the lateral direction and a respective resilient sleeve on the rigid connector that is configured to isolate the vibrations.

7. The outboard marine propulsion assembly according to claim 1, wherein the resilient sleeve comprises a plurality of radial ridges.

8. The outboard marine propulsion assembly according to claim 3, wherein both of the upper vibration isolating joint and the lower vibration isolating joint rotate about the steering axis when the marine drive is steered.

9. An outboard marine propulsion assembly comprising:

a marine drive having a supporting frame that extends from a top to a bottom in a longitudinal direction, from a port side to a starboard side in a lateral direction which is perpendicular to the longitudinal direction, and from a front to a rear in an axial direction which is perpendicular to the longitudinal direction and perpendicular to the lateral direction, a transom bracket assembly for coupling the marine drive to a marine vessel;

a steering arm and a swivel member that extends from the steering arm and is configured to be rotated relative to the transom bracket assembly to steer the marine drive, an upper yoke and an upper vibration isolating joint that extends laterally through the upper yoke to couple the steering arm to the supporting frame, and a lower yoke and a lower vibration isolating joint that extends laterally through the lower yoke to couple the swivel member to the supporting frame.

10. The outboard marine propulsion assembly according to claim 9, wherein the upper vibration isolating joint laterally extends through an upper portion of the supporting frame and wherein the lower vibration isolating joint laterally extends through a lower portion of the supporting frame.

11. The outboard marine propulsion assembly according to claim 10, wherein the upper vibration isolating joint and the lower vibration isolating joint both comprises a rigid connector that is laterally elongated and a resilient sleeve on the rigid connector, that is elongated in the lateral direction and configured to isolate vibrations emanating from the supporting frame.

12. The outboard marine propulsion assembly according to claim 11, wherein the rigid connector comprises laterally opposing eyelets for receiving fasteners for fixing the rigid connector.

13. An outboard marine propulsion assembly comprising:

a marine drive having a supporting frame, the supporting frame extending from a top to a bottom in a longitudinal direction, from a port side to a starboard side in a lateral direction which is perpendicular to the longitudinal direction, and from a front to a rear in an axial direction which is perpendicular to the longitudinal direction and perpendicular to the lateral direction, a transom bracket assembly, a steering arm and a swivel member that extends from the steering arm and is configured to be rotated relative to the transom bracket assembly to steer the marine drive, and a vibration isolating assembly that couples the swivel member to the supporting frame and is configured to isolate vibrations emanating from the marine drive to the transom bracket assembly, wherein the vibration isolating joint comprises a rigid connector that is elongated in the lateral direction and a resilient sleeve disposed between the rigid connector and at least one of the swivel member and the supporting frame, the resilient sleeve being elongated in the lateral direction and configured to isolate vibrations that emanate from the supporting frame.

14. The outboard marine propulsion assembly according to claim 13, wherein the vibration isolating assembly is one of an upper vibration isolating joint that couples an upper portion of the swivel member to the supporting frame, and a lower vibration isolating joint that couples a lower portion of the swivel member to the supporting frame.

15. The outboard marine propulsion assembly according to claim 14, comprising an upper yoke that couples the upper portion of the swivel member to the supporting frame via the upper vibration isolating joint and a lower yoke that couples the lower portion of the swivel member to the supporting frame via the lower vibration isolating joint.

16. The outboard marine propulsion assembly according to claim 14, wherein the swivel member defines a steering axis for the marine drive and wherein the upper vibration isolating joint and the lower vibration isolating joint are both elongated in a lateral direction which is perpendicular to the steering axis.

17. The outboard marine propulsion assembly according to claim 16, wherein the upper vibration isolating joint and the lower vibration isolating joint are parallel to each other.

18. An outboard marine propulsion assembly comprising:

a marine drive having a supporting frame, the supporting frame extending from a top to a bottom in a longitudinal direction, from a port side to a starboard side in a lateral direction which is perpendicular to the longitudinal direction, and from a front to a rear in an axial direction which is perpendicular to the longitudinal direction and perpendicular to the lateral direction, a steering arm and a swivel member that extends from the steering arm and is configured to seat in a transom bracket assembly such that rotation of the steering arm relative to the transom bracket assembly rotates the swivel member relative to the transom bracket assembly to thereby steer the marine drive, an upper vibration isolating joint that couples the steering arm to the supporting frame, and a lower vibration isolating joint that couples the swivel member to the supporting frame, wherein at least one of the upper vibration isolating joint and the lower vibration isolating joint comprises a rigid connector that is elongated in the lateral direction and a resilient sleeve on the rigid connector that is configured to isolate vibrations that emanate from the supporting frame.

* * * * *